United States Patent [19]

Bernard et al.

[11] 4,009,598

[45] Mar. 1, 1977

[54] AUTOMATIC TREATING AGENT DISPENSER FOR WASHING APPLIANCE

[75] Inventors: James A. Bernard, Dayton; Roy R. Smith, Eaton, both of Ohio

[73] Assignee: General Motors Corporation, Detroit, Mich.

[22] Filed: Nov. 26, 1975

[21] Appl. No.: 635,645

[52] U.S. Cl. ..... 68/12 R; 68/17 R; 68/207; 134/101; 134/113

[51] Int. Cl.[2] ..... D06F 39/02

[58] Field of Search ..... 68/12 R, 17 R, 207; 134/100, 101, 113, 104; 222/450, 425

[56] References Cited

UNITED STATES PATENTS

| | | | |
|---|---|---|---|
| 3,079,944 | 3/1963 | McLaughlin | 68/17 R X |
| 3,086,379 | 4/1963 | Plante | 68/17 R X |
| 3,120,329 | 2/1964 | Noakes | 68/17 R X |
| 3,133,673 | 5/1964 | Buss | 68/17 R X |
| 3,826,408 | 7/1974 | Berndt et al. | 68/17 R X |

*Primary Examiner*—Philip R. Coe
*Attorney, Agent, or Firm*—Edward P. Barthel

[57] ABSTRACT

A domestic clothes washer incorporating a system for dispensing predetermined amounts of liquid treating agents wherein an add-on storage tank reservoir is mounted on the washer control console. User operated valves provide gravity flow of the agents from the reservoir into dispensing vessels on the console. The vessels include calibrated viewing windows allowing the user to manually fill the vessels with wash agents to selected levels prior to each washing load for subsequent automatic emptying and passage into the washer during predetermined operations. Means are also provided to flush at least one of the emptied dispensing vessels to the washer drain by diverting a portion of the washer rinse water therethrough.

4 Claims, 5 Drawing Figures

AUTOMATIC TREATING AGENT DISPENSER FOR WASHING APPLIANCE

This invention relates to a dispenser apparatus for domestic appliances and more particularly to a multiple dispenser for a domestic clothes washing machine or the like incorporating a system for automatically dispensing controlled amounts of one or more liquid treating agents into the washer.

Various arrangements have been proposed by appliance manufacturers to incorporate multiple liquid treating agent dispensers as add-on features for domestic appliances, as for example, laundry machines, wherein liquid treating agents such as bleach, water conditioners, liquid detergents, fabric softeners and the like are released in a washer during the proper washing cycle of the machine. As discussed in the prior art U.S. Pat. No. 3,301,022 to F. D. Low, an important factor with respect to treating agents, such as bleach, is to introduce the correct amount of the agent with respect to the total amount of water since the strength of the solution is obviously dependent on this relationship. This is important as concentrated chlorine bleach poured onto clothes may adversely affect the useful life of the material. Another development of the dispensing art as regards the dispensing of wash agents such as fabric softener has been impeded by the tendency of such materials to clog the components of the dispenser as discussed in the U.S. Pat. No. 3,019,629, issued Feb. 6, 1962 to M. O. Ross.

Accordingly, it is an object of the present invention to provide a bulk storage dispenser for a washing appliance in conjunction with its automatic timer wherein one or more premeasured treating agents are dispensed at preselected times during the washing cycle.

Another object of the present invention is to provide a liquid wash agent dispenser for a washing machine including a bulk storage tank or reservoir for the liquid treating agents mounted for gravity flow of the agent into a dispensing vessel incorporating a calibrated viewing window enabling the user to fill the vessel by means of the viewing window to a desired level prior to the initiation of the washing cycle.

Another object of the present invention is to provide a liquid wash treating agent dispenser for a washing machine including a bulk storage tank for the wash agent with a manually operative first valve means providing for gravity flow into a dispensing vessel for premeasure of the agent together with second valve means operable by the washer timer mechanism automatically passing the agent into the wash while initiating a flushing operation in one of the emptied vessels whereby a portion of the water supplied to the machine through its fill mechanism is diverted into the vessel as a cleansing means therefore.

Further objects and advantages of the present invention will be apparent from the following description, reference being had to the accompanying drawings wherein a preferred embodiment of the present invention is clearly shown.

Figure 1:
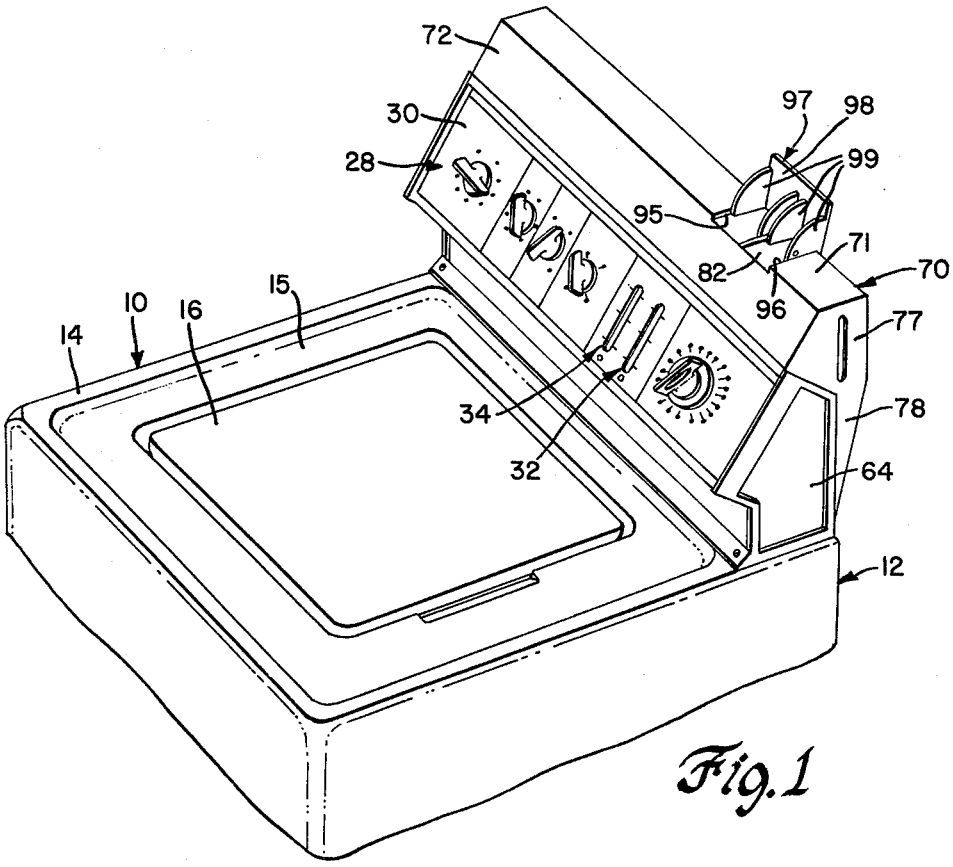
FIG. 1 is a fragmentary perspective view of a domestic clothes washer with its access door closed to illustrate the treating agent dispensing system of this invention.

Referring now to FIG. 1, there is shown, as an example of an automatic washing machine with which the invention may be used, an automatic clothes washer illustrated and generally referenced 10. The automatic washer 10 includes an outer sheet metal cabinet or casing 12 having a top wall 14 including a recessed portion 15 terminating in an access opening which is exposed when an access door 16 is opened. As partially indicated in FIG. 4, the casing 12 encloses a nested tub assembly 17 including an outer nonrotatable open top imperforate wall water container 18 and a rotatable, perforate wall spin basket 19. Spinning and agitation actions of the basket 19 and agitator (not shown) may be provided in a conventional manner by way of a transmission which is driven by a motor as shown for example in U.S. Pat. No. 3,663,975 issued May, 23, 1972 to A. D. Fish et al and assigned to the assignee of the instant application, the disclosure of which is incorporated by reference herein.

Figure 2:
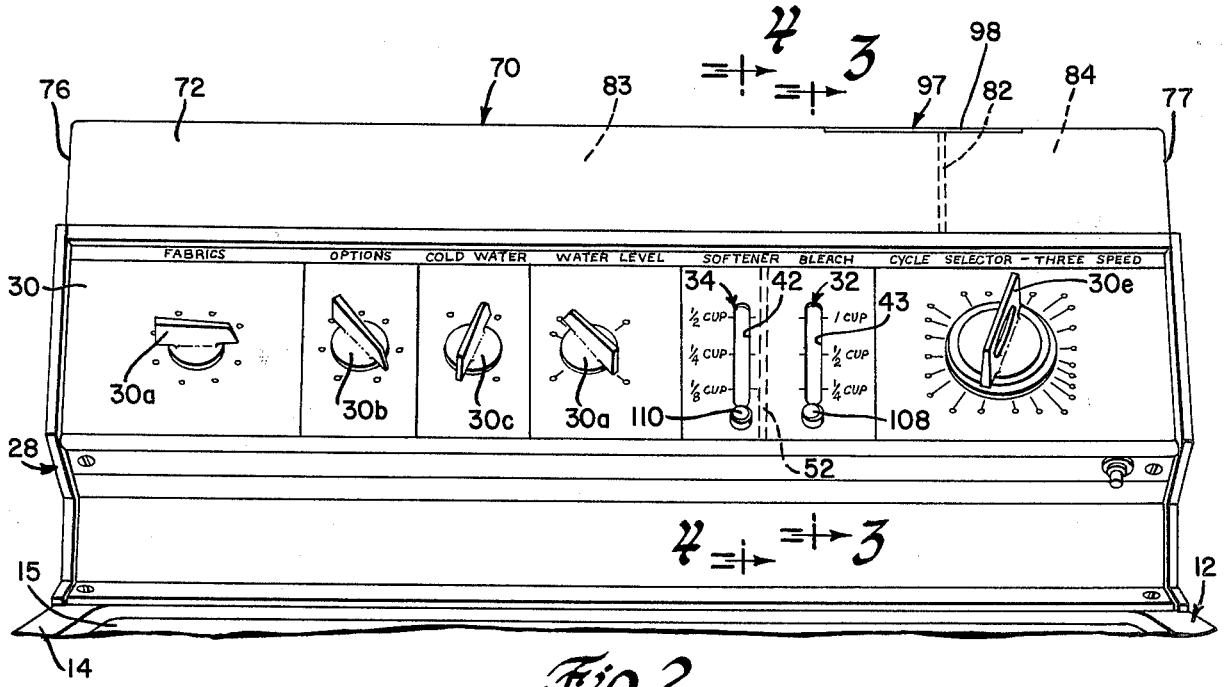
FIG. 2 is an enlarged fragmentary elevational view of the control console of the washing machine of FIG. 1.

As best seen in FIG. 2, the automatic clothes washer 10 further comprises a console, generally indicated at 28, having a rearwardly sloped control panel 30 which carries a plurality of functional remote control switches **30*a* through 30*e* which regulate the various washer functions. The control panel 30 also has located therein a plurality of liquid treating agent indicating means which in the preferred form of the invention are shown as a pair of viewing windows or "sight glasses" generally indicated at 32 and 34.**

Figure 4:
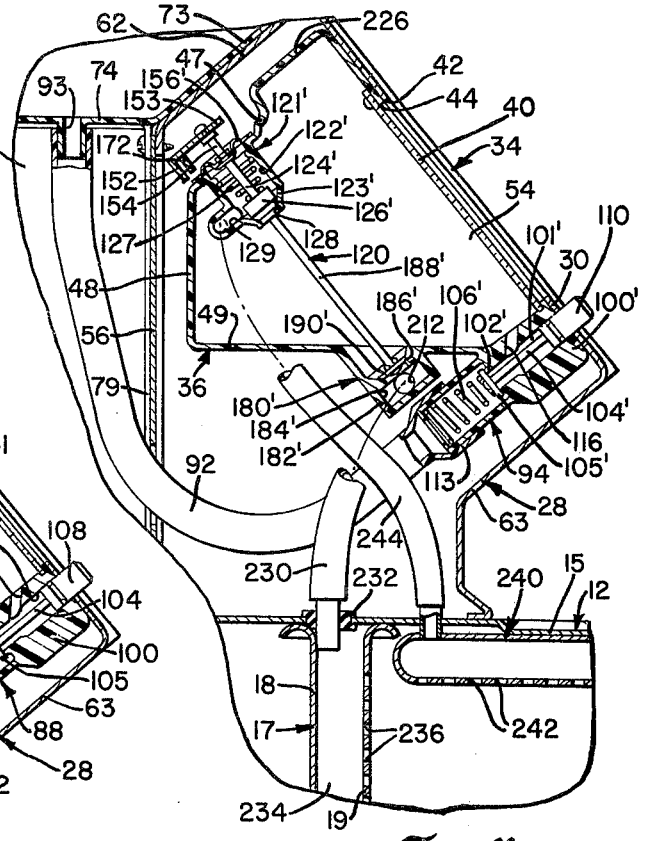
FIG. 4 is an enlarged fragmentary vertical sectional view taken on the line 4—4 of FIG. 2.
Figure 5:
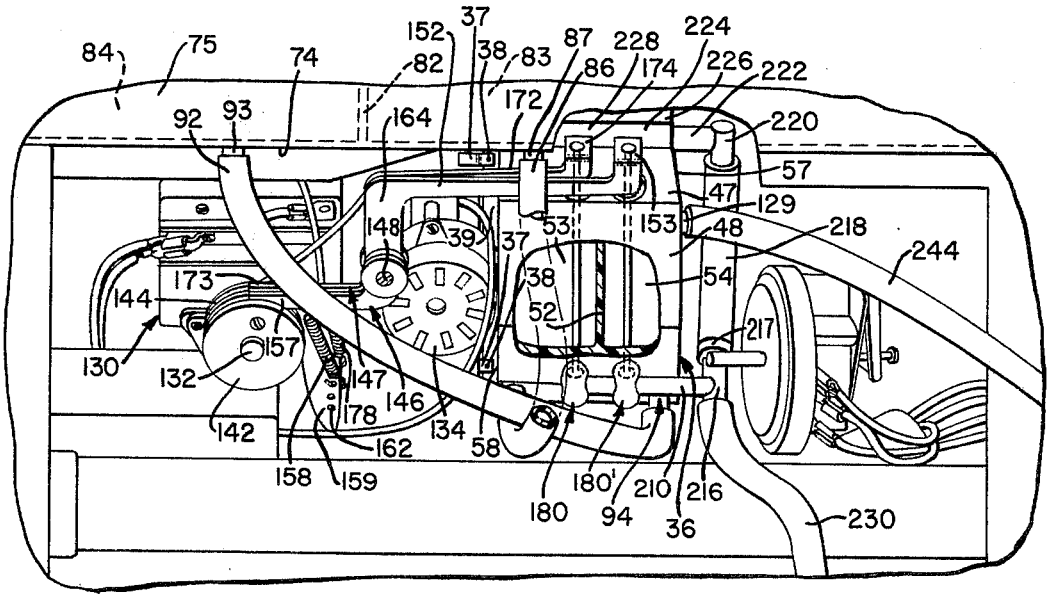
FIG. 5 is a fragmentary elevational view of a portion of the control console with rear panel removed.

As seen in FIGS. 4 and 5 of the disclosed embodiment the viewing windows are formed as part of a treating agent dispenser housing, generally indicated at 36, which is preferably molded of plastic material, shown mounted on the inner face of the control panel 30 by suitable means such as metal clips 37 held by threaded fasteners 38 with the clips clamping outwardly directed integral flanges 39 of the housing. The control panel has formed therein elongated apertures or ports 42 and 43 which overlie rectangular openings 44 and 45 in the forwardly sloping front wall 46 of the housing 36. In the disclosed form the housings are molded of opaque or transluscent plastic material, while each of the openings 44 and 45 are closed and sealed by a suitable transparent plastic sheet material 40 and 41 allowing the contents of each of the treating agent vessels to be viewed by the user through ports 42 and 43.

Figure 3:
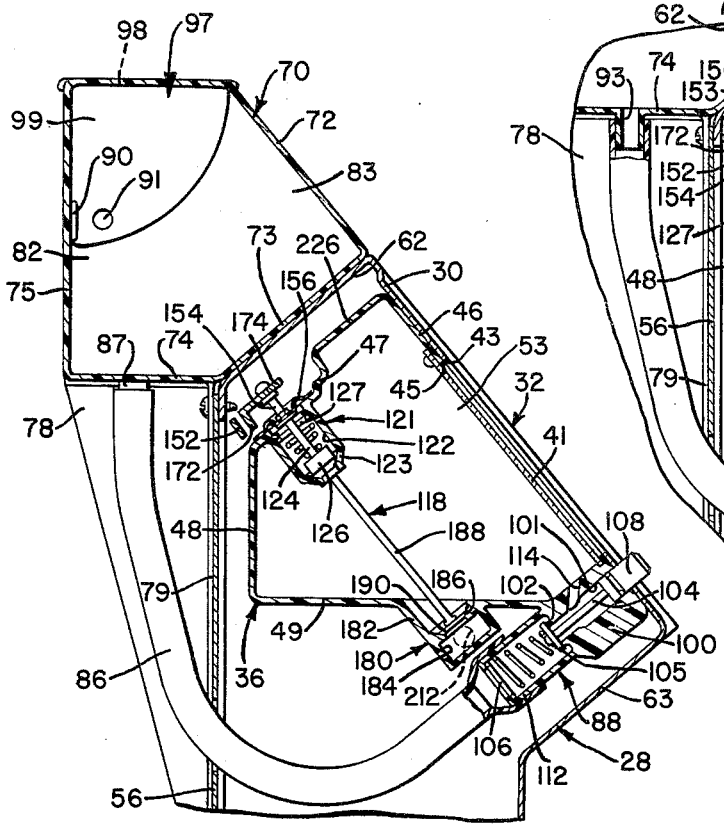
FIG. 3 is an enlarged fragmentary vertical sectional view taken on the line 3—3 of FIG. 2.

FIGS. 3 and 4 show the housing 36 to be generally polygonal in vertical section including a rearward sloping top wall 47, a vertical rear wall 48, and a horizontally disposed bottom wall 49. In the form shown the housing 36 is divided by vertical partition wall 52 into side-by-side dispensing vessels or chambers 53 and 54 with the vessel 53 designed to contain, when full, about one-cup liquid measure of a liquid washing or treating agent such as chlorine bleach, while the vessel 54 is designed to contain when full about ½ cup liquid measure of fabric softener or water conditioner. As viewed in FIG. 5, with the console rear wall 56 removed, it will be seen that dispenser housing partition 52 is asymmetrical or offset a predetermined amount so as to be closer to housing side wall 57 than housing side wall 58 to provide the unequal liquid measuring and dispensing vessels. FIG. 2 shows suitable indicia is provided on the control panel 30 adjacent the elongated parts 42 and 43 to indicate to the operator the level of treating agent in each chamber 54 and 53 respectively, which level can be compared to its associated indicia to enable the user to pre-measure the quantities therein in a manner to be explained. Also, the control panel 30 may include printed instructions to aid in the operation of the washer together with proper indicia relative to the control switches 30*a*–30*e*.

As seen in FIGS. 1 and 2, the console 28, in the preferred form, is an elongated box-like structure in which its rearward sloping top wall 62 and bottom wall 63 both formed at right angles to control panel 30, which together with the control panel 30, are preferably formed of one piece of sheet metal closed by side walls 64. The demountable back wall 56 encloses the rear access opening of the console 28.

With reference to FIGS. 1–4, a bulk storage container or reservoir member, generally indicated at 70, is shown supported on the sloping console top wall 62 which is divided into supply tanks each containing a substantial amount of a suitable liquid treating agent. The bulk storage reservoir 70 in the disclosed form is molded from suitable plastic material to provide a pentagon-shaped vertical section including a top wall 71 (FIG. 1), a forwardly sloping front wall portion 72, a rearwardly sloping support wall 73 coextensive with and supported as console wall 62, a bottom horizontal wall 74 and a rear vertical wall 75. The bulk storage container side walls 76 and 77 are substantially coplanar with the console side walls 64; with each side wall 76 and 77 having an integral gusset-like extension, one of which is shown at 78 in FIG. 3 for side wall 77. The gusset extensions each have integral right-angle flanges, such as flange 79 for extension 78, suitably secured to the console back wall plate 56 as by threaded fasteners (not shown).

In the present form of the invention the reservoir member 70 is divided by vertical partition 82 into two side-by-side unequal capacity liquid storage tanks 83 and 84. It will be seen in FIG. 5 that appropriate conduit means, such as flexible connecting tube 86, is provided to connect outlet 87 of the larger capacity storage tank 83 to inlet valve means 88 of measuring and dispensing vessel 53 which for purposes of the present disclosure contains liquid bleach. In a like manner suitable conduit means such as connecting tube 92 is provided to connect the outlet 93 of the smaller capacity tank 84 to inlet valve means 94 of a measuring and dispensing vessel 54 which in the disclosed invention contains a liquid fabric softener. As seen in FIG. 1, bulk storage fill means are provided in the form of openings 95 and 96 in top wall 71 positioned on either side of partition 82 with suitable closure means, such as pivotal closure member 97, a cover 98 and a plurality of separator guides 99 integrally formed thereon, operable to close the fill openings 95 and 96. As seen in FIG. 3, the outer guides are formed with outwardly extending stop flanges 90 and detents 91 to enable the closure member 97 to be retained in open position for ease in filling the tanks 83 and 84.

As seen in FIGS. 3 and 4, the inlet valve means 88 and 94 are preferably identical and consequently they are identified with similar elements given the same reference numerals, the exception being that each reference numeral for the vessel 54 valve means 94 is primed. The valve means 88, positioned with dispenser vessel 53, has a body 100 provided with a through bore 101 defining an annular valve seat 102 which is selectively closed by plunger 104 including a closure 105 biased toward the valve seat by coil spring 106. The plunger closure 105 is selectively urged away from valve seat 102 by the operator manually depressing plunger button 108, located on the end of plunger 104 so as to extend outward through the control panel 30 at a location beneath the bleach viewing sight window 34. In a similar manner the valve means 94, for the water softener dispenser vessel 54, has a manually operated plunger button 110 shown located beneath the softener viewing sight window 32. The conduits or lines 86 and 92 in the disclosed form are formed of elastic rubber-like material with their lower ends connected to the inlets 112 and 113 of their associated valve housings.

Thus, upon the operator depressing the button 108, for example, bleach treating agent is fed by gravity flow from reservoir 83 through the tube 86 to the valve inlet 112 past the unseated valve closure 105, into bore 101 and exits the valve outlet passage 114 into the bleach dispensing vessel 53. In like manner upon the button 110 being depressed by the user the water softener agent is caused to flow from reservoir tank 84 through the tube 92 to the valve inlet 113 and exits the valve outlet 116 for flow into the softener dispensing vessel 54.

The treating agent dispensing vessels 53 and 54 further include outlet valve means generally indicated at 118 and 120 which are of similar construction with the similar elements given the same reference numeral, the exception being that each reference numeral for the water softener dispensing vessel valve means 120 is primed. Thus, valve means 118 in the disclosed form includes an upper valve body 121 integrally molded into wall 47 provided with a cylindrical bore 122, defining, at a lower position, an annular valve seat 123 which is selectively closed by a plunger 124 with first valve closure means in the form of a valve poppet 126 selectively biased toward the valve seat by a coil spring 127. The valve plunger 124 is selectively urged away from valve seat 123 by suitable connection means to be described, operated by timer means which in the form shown is a conventional washer timer switch generally indicated at 130 in FIG. 5.

As seen in FIG. 2, the control knob 30*e* of the timer is conventional in the art, and is manually operated by the user to rotate a drive shaft 132 and set the main timer cams (not shown) at a start position, from which the cams are then mechanically driven by a main timer motor 134. The control knob 30*e*, as shown, may be set at any of a variety of positions based on the clothes' condition and material such as REGULAR SOAK; PRE-WASH or EXTRA RINSE, PERMANENT PRESS or KNITS or EXTRA RINSE. FIG. 5 shows the timer cam shaft 132 provided with an additional pair of first and second cam members 142 and 144 each having a periphery of substantially constant radius and each having a pair of notches (not shown) disposed therein for purposes to be described below.

A pair of first and second treating agent start and stop lever members 146 and 147 are shown in FIG. 5 rotatably disposed on the end of a pin member 148, fixed to and extending rearwardly from timer motor bracket (not shown) such that the lever members are adapted to rotated in a plane substantially perpendicular to the axis of the timer shaft 132. The rearmost lever 146 is in the form of a double-L shaped actuating lever with its upper lever arm 152 having a right-angled flange 153 at its free end shown in FIG. 4 connected to the upper end 154 of valve plunger 124' which extends through a flexible seal 156' sealing the upper open end of valve housing 121'. The double-L lever 146 has the free end of its lower lever arm 157 provided with a cam follower (not shown) adapted to engage cam notches on the surface of cam 142. A spring member 158 is shown disposed between the lower lever arm 157 and bracket 159 so as to bias double-L lever 146 in a counterclockwise direction toward the cam shaft 132. The bracket 159 is shown with a plurality of holes 162 to allow adjustment of the tension coil spring 158. The double-L lever 146 has its intermediate leg 164 pivotally supported on pin 148.

It will be noted in FIG. 5 that the second start and stop double-L lever 147 has an upper actuating lever arm 172 and a lower lever arm 173 connected by a vertical leg portion (not shown) pivoted on pin 148 to rotate in a plane parallel to double-L level 146. The upper actuating lever arm 172 has a right-angled flange 174 shown in FIG. 3 connected to the upper extension 154 of valve 118 plunger 124. In a like manner to double-L lever 147 has a cam follower (not shown) on the free end of its lower lever arm 173 adapted to sequentially engage cam notches on the surface of second or forward cam member 144. A coil spring member 178 is partially shown disposed between the lower lever arm 173 and bracket 159 similar to spring 158, so as to bias second double-L lever 147 in a direction toward the cam shaft 132.

As viewed in FIG. 3, valve means 118 includes the upper valve body 121 and a second lower valve body 180 which in the disclosed form is cylindrical in shape and integrally molded on bottom wall 49 of the dispensing vessel 53 defining a cylindrical bore 184 having an annular valve seat 186. A lower extension or rod 188 on plunger 124 includes a lower valve closure or poppet 190 which is selectively biased toward the valve seat 186 by the valve coil spring 127. The lower valve closure 190 is selectively urged away from the valve seat 186 in unison with the upper valve closure 126 by the washer timer connection means 146.

Referring now to FIG. 4, the valve means 120 includes a second or lower valve housing or body 180'. As seen in FIG. 5 the valve housings 180 and 180' are interconnected by a transverse conduit generally indicated at 210 providing manifold means for interconnecting the two lower valve chambers 184 and 184' by means of a common passageway 212 having one end extending beyond the side wall 57 of the dispenser housing 40 so as to communicate via a right angle tap with connected 216 having its upper end 217 connected by flexible conduit 218 to an elbow member 220. The elbow 220 has its 90° tap 222 connected to an elongated box-shaped manifold portion 224 formed integrally with the top wall 47 of the dispenser housing 40 by means of an offset upper wall 226 and right-angled side wall 228. The box-shaped manifold portion 224 communicates with both dispensing vessels 53 and 54 to equalize the pressure within the dispenser vessels and prevents any mixture of water or treating agents to be drawn back into the supply line, thereby allowing the treating agents to flow by gravity out exit conduit 230 to the washing chamber 18.

It will be seen in FIGS. 3–5 that with the above-disclosed arrangement of parts, upon the plunger button 108 being depressed by the user it will cause an opening of the valve closure 105 to allow the treating agent in bulk storage reservoir 83 such as liquid bleach, to flow by means of gravity through the conduit 86 and through valve inlet 112 and valve outlet passage 114 into the dispensing vessel 53 whereby the upwardly progressing level of liquid can be observed through the viewing window 32. By virtue of the indicia along the viewing window slot or opening 43, which is calibrated to designate the different volumetric capacities of the dispensing vessel 53 corresponding to the level of the liquid in the viewing window, the visual volume filling of the dispensing vessel 53 may be readily affected. In a like manner the dispensing vessel 54 may be filled by the operator depressing button 110 and observing the liquid level in viewing window 34.

Referring now to FIGS. 1–5, the complete operation will be described using the assumption of a normal load to be washed and is intended that the liquid bleach and liquid fabric softener are to be provided in the dispensing vessels 53 and 54, respectively. With this assumption, the desired washing cycle is selected by the rotary switch of the timer and the rotating knob is pushed inwardly closing the timer switch, the timer motor will start to operate. After a selected time period of operation during the wash cycle indicated by suitable indicia on the timer dial, the cam 144 rotates one of its notches into a correct position causing the lower lever arm 157 to pivot downwardly and upper lever arm 172 to pivot upwardly lifting the valve stem extension 154 and opening the valve closure member 126 and 190. The opening of the valve closure 190 permits bleach within the dispensing vessel 53 to flow by gravity through the valve chamber 184 and into the exit line 210 and thence into the connector 216 and be carried by means of discharge tube or conduit 230 to the outlet host grommet 232 held securely in an aperture of the top 15. The washing agent bleach will be projected into the bulkhead area 234 between the outer tub and inner spin tub 19. The raw bleach is then allowed to comingle or mix with the wash water in the bulkhead 234 thus avoiding having concentrated chlorine bleach being directly poured onto the clothes in the washing tub and avoiding the adverse effect on the strength of the fibers forming the clothes to prevent damage thereto. The bleach and water mixture then flows through the inner tub apertures 236 into the tub 19 to perform its function at any selected point in the washing cycle depending upon the setting of the timer cam 142. Upon further rotation of the cam 142 by the shaft 132, the cam follower of lower lever arm 157 moves out of its cam notch resulting in the seating of the valve closure 190.

At the conclusion of the wash cycle and at some point during the rinse cycle determined by the rotation of the timer shaft 132 the end of the lower lever arm 173 moves radially inwardly toward the shaft 132 to actuate the softener liquid agent valve closures 126' and 190' to open position. At this time the softener treating agent within the vessel 54 follows a gravity course into the valve chamber 184' and by means of common discharge passage 212 and connector 216 the water softener agent flows through the discharge conduit 230 into the bulkhead 234 in a manner identical to the bleach treating agent. As wash agents such as water softeners do not mix or dissolve easily in water, they have a tendency to plug or clog the control valves of a dispensing system. To alleviate this problem applicant has provided a self-cleaning feature which is initiated by the same means utilized to actuate the dispensing operation. Thus, the timer cam 144 is arranged to keep both the upper valve closure 123' and the lower valve closure 190' open during a portion of the final spray rinse of the automatic washer. In this way, after the softener agent has drained from the dispensing vessel 54, water fills the tub rinse tube, indicated generally at 240 in FIG. 4, at supply pressure to cause issuance thereof in a plurality of pressure sprays from the slots 242 arranged around the bottom of the tube 240. A portion of the pressurized rinse water is forced through line or conduit 244 from the spray rinse tube upwardly under pressure into the inlet opening 129 of the upper valve housing 121' and into cylindrical bore 122'. Because both the upper valve closure 126' and lower valve closure 190' of valve means 120 in the water softener treating agent vessel 54 are held in their open position by the timer cam 144, a portion of the rinse water enters through the upper valve outlet 128' to dissolve any remaining treating agent in vessel 54 and the dilution water is withdrawn from the vessel 54 and flushed via lower valve 180 and its gravity drain passages into the drain of the washer.

While the embodiment of the present invention as herein disclosed constitutes a preferred form, it is to be understood that other forms might be adopted.

We claim:

1. In a laundry machine having an outer rectangular shaped casing, said casing having an upper wall defining upper edges with said casing, a receptacle for receiving laundry and water supply means for providing water to said receptacle, a hollow control housing above said receptacle on said upper wall, including a front wall and a top wall, extending along an upper edge of said outer casing, a dispensing compartment in said control housing, a settable timer control for initiating and controlling a cycle of operations of the machine including sequential periods of wash and rinse, a liquid agent storage reservoir removably mounted on said top wall above said dispensing compartment, said reservoir providing a storage tank holding a treating agent, means for manually releasing the treating agent from said storage tank into said dispensing compartment in said control housing, means for dispensing the treating agent from said dispensing compartment into the laundry receptacle during a period of wash or rinse; liquid conduit means, including manually operable valve control means therefor, communicating between said storage tank and said dispensing compartment; said front wall having an elongated transluscent viewing window associated with said dispensing compartment providing a view of the level of liquid agent therein, said manually operable valve control means being operable for controlling the gravity flow of a liquid agent from said storage tank into said dispensing compartment, indicia means for said viewing window allowing the operator to preselect the quantity of liquid agent to be dispensed by comparing the level of said liquid agent in said viewing window with the desired indicia means while said valve control means is being manually operated and said liquid agent is flowing from said storage tank to said dispensing compartment, and liquid conduit means, including timer operable valve control means therefor, communicating between said dispensing compartment and the laundry receptacle for automatically delivering the preselected quantity of liquid agent to said receptacle.

2. In a laundry machine having an outer casing, said casing having an upper wall defining upper edges with said casing, a receptacle for receiving laundry and water supply means for providing wash and rinse water to said receptacle, a hollow control housing above said receptacle including a front wall and a top wall extending along an upper edge of said outer casing, a plurality of dispensing compartments in said control housing, a settable timer control for initiating and controlling a cycle of operations of the machine including sequential periods of wash and rinse, a liquid agent storage reservoir removably mounted on said top wall, above said dispensing compartments, said reservoir separated into a plurality of storage tanks each holding a treating agent, means for manually releasing a treating agent from a storage tank into an associated dispensing compartment in said control housing means for sequentially dispensing the treating agents from said dispensing compartments into the laundry receptacle during said periods of wash and rinse; liquid conduit means, each including manually operable valve control means therefor, communicating between each said storage tank and its associated dispensing compartment; said front wall having an elongated transluscent viewing window associated with each said dispensing compartment providing a view of the level of liquid agent therein, each said manually operable valve control means being operable for controlling the gravity flow of a liquid agent from its respective storage tank into its associated dispensing compartment, indicia means for each of said viewing windows allowing the operator to preselect the quantity of liquid agent to be dispensed by comparing the level of said liquid agent in said viewing window with the desired indicia means while said valve control means is being manually operated and said liquid agent is flowing from one of the storage tanks to its associated dispensing compartment, and liquid conduit means, including timer operable valve control means therefor, communicating between each said dispensing compartment and the laundry receptacle for automatically delivering the preselected quantity of liquid agent to said receptacle.

3. In a laundry machine having an outer casing, said casing having an upper wall defining upper edges with said casing, a receptacle for receiving laundry and water supply means for providing wash and rinse water to said receptacle, a hollow control housing above said receptacle including a front wall and a top wall extending along an upper edge of said outer casing, a plurality of dispensing compartments in said control housing, a settable timer control for initiating and controlling a cycle of operations of the machine including sequential periods of wash and rinse, a liquid agent storage reservoir removably mounted on said top wall above said dispensing compartments, said reservoir separated into a plurality of storage tanks each holding a treating agent, means for manually releasing a treating agent from a storage tank into an associated dispensing compartment in said control housing, means for sequentially dispensing the treating agents, from said dispensing compartments into the laundry receptacle during said periods of wash and rinse; liquid conduit means, each including manually operable valve control means therefor, communicating between each said storage tank and its associated dispensing compartment; said front wall having an elongated transluscent viewing window associated with each said dispensing compartment providing a view of the level of liquid agent therein, each said manually operable valve control means being operable for controlling the gravity flow of a liquid agent from its respective storage tank into its associated dispensing compartment, indicia means for each of said viewing windows allowing the operator to preselect the quantity of liquid agent to be dispensed by comparing the level of said liquid agent in said viewing window with the desired indicia means while said valve control means is being manually operated and said liquid agent is flowing from one of the storage tanks to its associated dispensing compartment, liquid conduit means, including timer operable valve control means therefor, communicating between each said dispensing compartment and the laundry receptacle for automatically delivering the preselected quantity of liquid agent to said receptacle, and at least one of said timer operable valve control means comprising upper and lower valves, said upper and lower valves operable by said timer control in unison during one of the wash and rinse periods, flush water conduit means communicating between said water supply means and said upper valve, said timer control operative to open said lower valve to dispense its associated treating agent into the laundry receptacle while opening said upper valve to allow said flush water conduit means to direct a portion of the water provided by said water supply means during said one of said periods into its associated dispensing compartment to flush the treating agent therefrom.

4. In a laundry machine having an outer casing, said casing having an upper wall defining upper edges with said casing, a receptacle for receiving laundry and water supply means for providing wash and rinse water to said receptacle, a hollow control housing above said receptacle including a front wall and a top wall extending along an upper edge of said outer casing, a dispensing compartment in said control housing, a settable timer control for initiating and controlling a cycle of operations of the machine including sequential periods of wash and rinse, a liquid agent storage reservoir removably mounted on said top wall above said dispensing compartment, said reservoir providing a storage tank holding a treating agent, means for manually releasing the treating agent from said storage tank into said dispensing compartment in said control housing, means for dispensing the treating agent from said dispensing compartment into the laundry receptacle during a period of wash or rinse; liquid conduit means communicating between said storage tank and said dispensing compartment; said conduit means including manually operable valve means therefore, said front wall having an elongated transluscent viewing window associated with said dispensing compartment providing a view of the level of liquid agent therein, said manually operable valve control means being operable for controlling the gravity flow of a liquid agent from said storage tank into said dispensing compartment, indicia means for said viewing window allowing the operator to preselect the quantity of liquid agent to be dispensed by comparing the level of said liquid agent in said viewing window with the desired indicia means while said valve control means is being manually operated and said liquid agent is flowing from said storage tank to said dispensing compartment, liquid conduit means, including timer operable valve means therefor, communicating between said dispensing compartment and the laundry receptacle for automatically delivering the preselected quantity of liquid agent to said receptacle, and said timer operable valve control means comprising a pair of valves, said pair of valves operable by said timer control in unison during one of the wash or rinse periods, flush water conduit means communicating between said water supply means and one of said pair of valves, said timer control operative to open the other of said pair of valves to dispense its treating agent into the laundry receptacle while opening said one valve to allow said flush water conduit means to direct a portion of the water provided by said water supply means during said one of said periods into said dispensing compartment to flush the treating agent therefrom.

* * * * *